United States Patent [19]

Gili Bas

[11] 4,424,690

[45] Jan. 10, 1984

[54] DRUM APPARATUS FOR THE TREATMENT OF HIDES, LEATHERS AND THE LIKE

[76] Inventor: Francisco J. Gili Bas, Calle Lincoln, 44, Barcelona 6, Spain

[21] Appl. No.: 253,158

[22] Filed: Apr. 10, 1981

[30] Foreign Application Priority Data

May 13, 1980 [ES] Spain ..... 250.665

[51] Int. Cl.[3] ..... A43B 13/12

[52] U.S. Cl. ..... 69/30

[58] Field of Search ..... 69/30, 31

[56] References Cited

U.S. PATENT DOCUMENTS 1,893,706 1/1933 Kannel ..... 69/30

3,735,611 5/1973 Pillard ..... 69/30

3,913,360 10/1975 Holdsworth ..... 69/30

FOREIGN PATENT DOCUMENTS 2717649 10/1978 Fed. Rep. of Germany ..... 69/31

*Primary Examiner*—Patrick D. Lawson

*Attorney, Agent, or Firm*—Steinberg & Raskin

[57] ABSTRACT

Drum apparatus for the treatment of hides, leathers and the like include a substantially cylindrical member having an inner interior defining surface and a plurality of substantially radially extending paddles situated within the interior. The paddles have respective lengths less than the length of the cylindrical member and together extend over substantially the entire length of the cylindrical member. The paddles form at least two groups, the paddles of each group being substantially situated in a common diametric plane, each diametric plane being both angularly and longitudinally offset relative to the diametric planes of the remaining groups of paddles.

6 Claims, 6 Drawing Figures

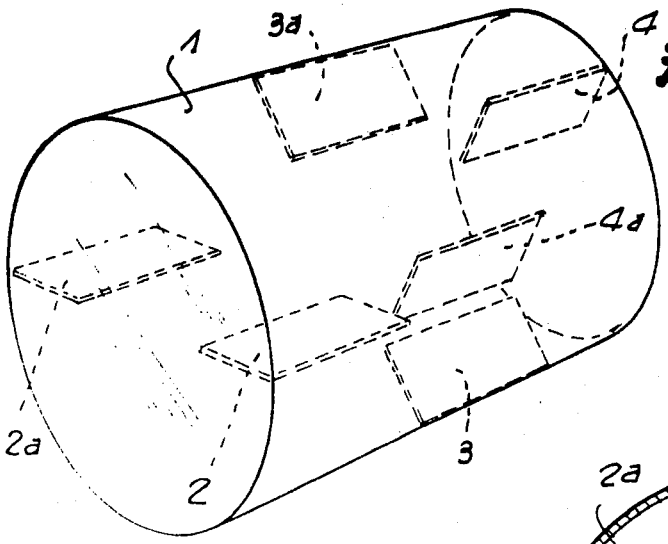
FIG. 1
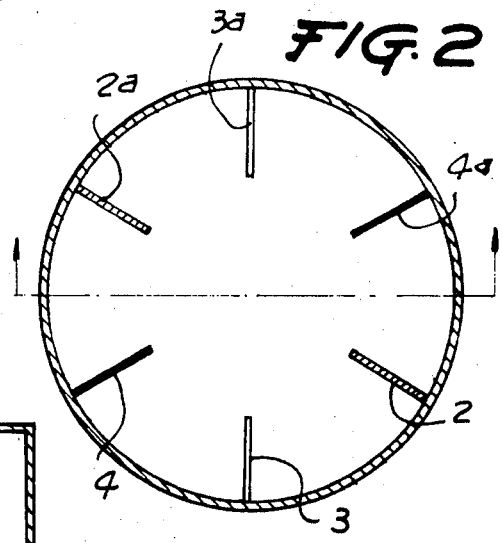
FIG. 2
FIG. 3
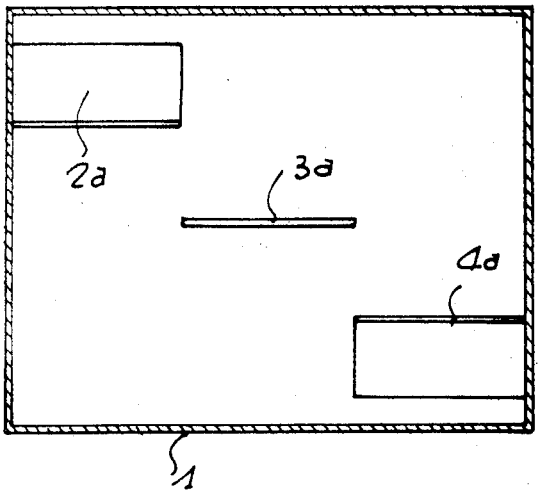

DRUM APPARATUS FOR THE TREATMENT OF HIDES, LEATHERS AND THE LIKE

BACKGROUND OF THE INVENTION

This invention generally relates to the treatment of hides and leathers and, more particularly, to drum apparatus for effecting such treatment in a softer and more efficient manner than is possible utilizing conventional apparatus.

Hides and leathers are conventionally treated in rotating drum apparatus containing a bath including tanning, dyeing and other materials. Conventional drum apparatus include stakes or paddles which move the hides through the bath and then raise them to a predetermined height from which they are dropped into the bath thereby intensifying the diffusion of the bath into the hides.

Since the above-described operation necessarily results in hides impacting both against the bath and against each other, conventional drum apparatus are generally not used for hides having hair or fur since the impacts which occur felt or mat or otherwise damage the fur or hair irreversibly.

In order to diminish the effect of the impacts, the rotational speed of the drum apparatus has been reduced. However, this has the drawback of reducing the agitation to which the hides or leather are subjected thereby slowing the rate of diffusion of the tanning, dyeing and other materials of the bath through the hides and resulting in irregularities in the operation and treatment.

Attempts have been made to overcome the drawbacks discussed above by providing the drums with paddles which are inclined relative to the generatrix of the cylinder at alternately opposite angles so that the hides tend to shift from one side to the other. However, the results obtained using this provision have not been entirely satisfactory.

SUMMARY OF THE INVENTION

Accordingly, it is an object of the present invention to overcome the various drawbacks discussed above inherent in conventional rotating drum apparatus for the treatment of hides and leathers.

A particular object of the present invention is to provide new and improved drum apparatus for the treatment of hides and leathers wherein hides and leathers, both with or without hair or fur, can be treated in an extremely efficient manner without the possibility of felting or otherwise damaging the same.

Briefly, in accordance with the present invention, these and other objects are attained by providing drum apparatus including a cylindrical member having a plurality of radial paddles extending into the interior, the paddles each having a length less than the length of the cylindrical member and being substantially parallel to the generatrix thereof.

The height of the paddles is always less than the length of the radius of the cylindrical member.

Although being radially displaced from each other, the paddles are situated so as to occupy and extend over the entire length of the cylindrical member so that the sum of their lengths corresponds to the length of the generatrix of the cylinder.

Furthermore, the paddles are preferably arranged in groups of at least two diametrically opposed paddles substantially situated in a common diametric plane.

Each diametric plane in which a group of at least two paddles are situated in both angularly and longitudinally offset relative to the diametric planes of the remaining groups of paddles in a substantially regular pattern.

As explained in greater detail hereinbelow, the structure of the drum apparatus of the present invention allows the same to operate at high speeds with the detrimental impacts which normally occur in conventional equipment being eliminated and yet providing uniform treatment throughout the entire drum without producing felting of the hides.

DESCRIPTION OF THE DRAWINGS

A more complete description of the present invention and many of the attendant advantages thereof will be readily appreciated as the same becomes better understood by reference to the following detailed description when considered in connection with the accompanying drawings in which:

FIG. 1 is a schematic perspective view of the drum apparatus of the present invention illustrating one embodiment of the disposition of the paddles within the cyindrical member;

FIG. 2 is a transverse cross-sectional view of the embodiment of the drum apparatus of the present invention illustrated in FIG. 1 and illustrating the radial and angularly spaced disposition of the paddles;

FIG. 3 is a longitudinal cross-sectional view taken along line 3—3 of FIG. 2 and illustrating the staggered disposition of the paddles along the generatrix of the cylindrical member;

DESCRIPTION OF THE PREFERRED EMBODIMENTS

Figure 4:
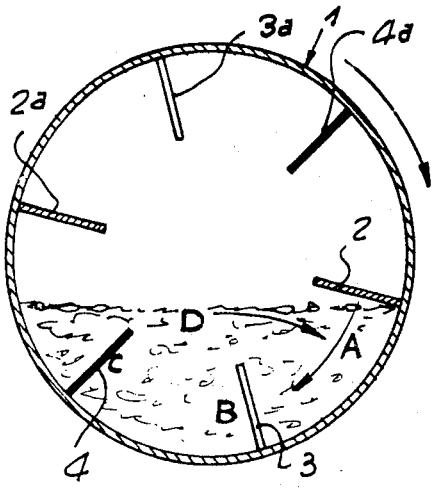
FIGS. 4–6 illustrate three successive phases during the rotational operation of the drum apparatus of the present invention and illustrating the movement of the hides through the bath.

Referring now to the drawings wherein like reference characters designate identical or corresponding parts throughout the several views, and more particularly to FIGS. 1–3, the drum apparatus of the present invention includes a cylindrical member 1 which is adapted to rotate about its central longitudinal axis by conventional rotatable support means which are not shown for purposes of clarity, and three pairs of paddles, 2, 2*a* and 3, 3*a*, and 4, 4*a*.

As seen in the figures, all of the paddles are fixed to the inner surface of the cylindrical member 1 and extend radially into the interior thereof. As best seen in FIG. 3, the sum of the lengths of one paddle of each of the pairs of paddles corresponds to the total length of the cylindrical member 1. Thus, the length of each of the paddles is less than the total length of the cylindrical member 1 and in the illustrated embodiment, the length of each of the paddles is about $\frac{1}{3}$ the length of the cylindrical member. The height of each of the paddles is generally within the range of about 1/5 to $\frac{2}{3}$ of the length of the radius of the cylindrical member 1.

The plurality of paddles form three groups, each group being constituted by a respective pair of paddles 2, 2*a* and 3, 3*a* and 4, 4*a* substantially situated in a common diametric plane. Each diametric plane is both angularly and longitudinally offset relative to the diametric planes of the remaining groups of paddles so that the cylindrical member is divided into three longitudinal zones. The angular and longitudinal offset of the diametric planes are perferably substantially regular.

Thus, in the illustrated embodiment of the drum apparatus of the present invention, the work performed by the paddles within the cylindrical member is carried out in three zones, each zone corresponding to a particular pair of paddles. Together the zones occupy substantially the entire useful length of the cylindrical member 1.

Furthermore, it will be understood that both the number of paddles situated in a particular zone as well as the number of groups of paddles can vary within the scope of the present invention.

In operation, the drum apparatus of the present invention results in a more efficient movement of the hides through the bath. In this connection, not only is the movement of each hide increased but, additionally, the relative movement between the hides is also increased so that the hides will rub against each other to a significant extent as they are displaced in the cylindrical member. This action facilitates the absorption and fixation of the bath components in the hides in a more rapid manner than has been possible utilizing conventional techniques, such as rotating wheels and low speed hide-bath-hide arrangements.

Figure 5:
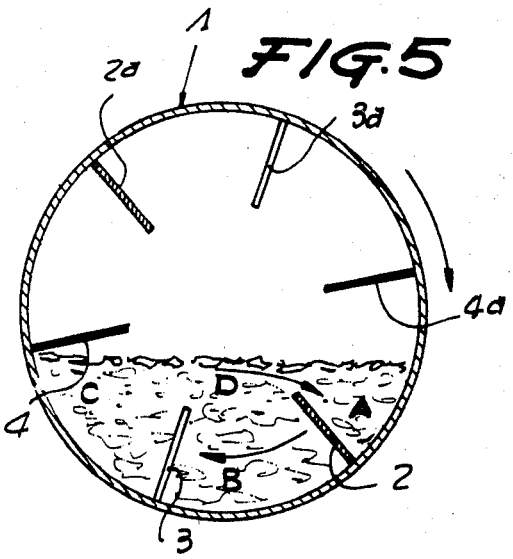
Figure 6:
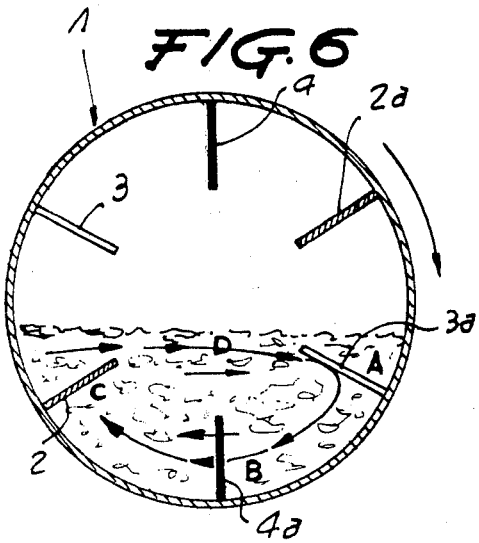

Referring now to FIGS. 4–6, three phases of rotational movement of the drum apparatus are illustrated together with the movement of the hides resulting from the rotation of the drum apparatus.

Referring to FIG. 4, the paddle 2 enters the bath in zone A at a rate of, for example, 2–10 times per minute, depending upon the particular application. The paddle 2 drags the hides which are encountered at an approximate ratio of 1:3 to 1:5 (weight of hides per liquid volume), transporting the hides to zone B of the bath. At the same time, the zone A is occupied by hides which were located in zone D.

It should be noted that during the phase of operation as illustrated in FIG. 4, in addition to the displacement of the hides from zone D to zone A and from zone A to zone B, a zone of high friction is created between zones D and B as shown in FIG. 5 due to the fact that the hides circulate in opposite directions in the various zones.

As paddle 2 continues to rotate with cylindrical member 1, the hides originally in zone A and now present in zone B are carried to zone C from where they are directed to zone D. From this zone, the hides move to another longitudinal zone of the cylinder to begin a new cycle through the bath as described below.

It is noted that the dispersement of the hides illustrated in FIGS. 4–6 and discussed above is effected through the rotation of one of the paddles 2 in a particular longitudinal zone. However, it is understood that paddles 3,3*a* and 4, 4*a* are also present within cylindrical member 1 in addition to paddle 2*a* which is paired with paddle 2. These paddles act in different planes of the cylindrical member and are offset due to the axial and angular displacement of the paddles. For example, FIG. 4 illustrates the situation wherein paddle 2 is about to be immersed in the bath with paddle 3, which is longitudinally and angularly displaced from paddle 2 preceeding paddle 2 in clockwise rotation being in zone B of the bath. Paddle 4 which is angularly and longitudinally farthest removed is about to emerge from the bath.

Referring to FIG. 5, it is seen that paddle 2 is in zone B, paddle 3 is in transition between zones B and C and paddle 4 has just emerged from the bath while paddle 4*a* which is in the same diametric plane as paddle 4 is approaching the bath. Thus, both paddles 4 and 4*a* are inactive while paddles 2 and 3 are fully active.

Referring to FIG. 6, it is seen that paddle 2 has moved to zone C while paddle 3 has emerged from the bath. However, paddle 3*a* has now entered into zone A while paddle 4*a* is fully emerged within zone D.

It is seen from the above that the rotational displacement of the hides within the bath, illustrated in FIG. 6, will take place in various offset planes within the cylindrical member 1 due to the location of paddles 3, 3*a* and 4, 4*a*, thereby resulting in additional rubbing of the hides which even further enhances the action of the bath.

Accordingly, it is possible to obtain an extremely efficient action of the bath on the treated hides without having to operate the drum apparatus at high speeds and without the occurrence of impacts or falls of the hides in the bath. The action is uniform throughout the length of the entire cylindrical member without producing felting of the hides. For this reason, the drum apparatus of the present invention is especially suited for treatment of hides having hair and fur.

Obviously, numerous modifications and variations of the present invention are possible in the light of the above teachings. It is therefore to be understood that within the scope of the claims appended hereto, invention may be practiced otherwise than is specifically disclosed herein.

What is claimed is:

1. Drum apparatus for the treatment of hides, leathers and the like, comprising; a substantially cylindrical member having an inner interior defining surface, and a plurality of substantially radially extending paddles within said interior and fixed to the inner surface of said cylindrical member, said paddles having respective lengths substantially less than the length of said cylindrical member and being longitudinally separated with respect to each other, said paddles being situated in different diametric planes and such that no two paddles are axially aligned with each other, said paddles together extending over substantially the entire length of said cylindrical member.

2. The combination of claim 1 wherein said plurality of paddles form at least two groups, the paddles of each group being substantially situated in a common diametric plane, each diametric plane being both angularly and longitudinally offset relative to the diametric planes of the remaining groups of paddles so that the cylindrical member is divided into at least two longitudinal zones.

3. The combination of claim 2 wherein said plurality of paddles form three groups and wherein each of said paddles has a length of about $\frac{1}{3}$ the length of said cylindrical member.

4. The combination of claim 1 wherein the height of each of said paddles is in the range of about 1/5 to $\frac{2}{3}$ the radius of said cylindrical member.

5. The combination of claim 2 wherein each of said groups includes a pair of diametrically opposed radially extending paddles situated in a particular diametric plane, the sum of the lengths of one of said paddles from each of the groups being approximately equal to the length of said cylindrical member.

6. The combination of claim 2 wherein the angular and longitudinal offset of said diametric planes are substantially regular.

* * * * *